US007089714B2

(12) United States Patent
Thomas

(10) Patent No.: US 7,089,714 B2
(45) Date of Patent: Aug. 15, 2006

(54) APPARATUS AND METHOD FOR FORMING VOID-FILL PACKAGING

(75) Inventor: Keith Frederick Thomas, Gloucestershire (GB)

(73) Assignee: Green Light Packaging Limited, Kent (GB)

( * ) Notice: Subject to any disclaimer, the term of this patent is extended or adjusted under 35 U.S.C. 154(b) by 50 days.

(21) Appl. No.: 10/510,734

(22) PCT Filed: Mar. 14, 2003

(86) PCT No.: PCT/GB03/01093

§ 371 (c)(1),
(2), (4) Date: Oct. 12, 2004

(87) PCT Pub. No.: WO03/086742

PCT Pub. Date: Oct. 23, 2003

(65) Prior Publication Data

US 2005/0155326 A1 Jul. 21, 2005

(30) Foreign Application Priority Data

Apr. 12, 2002 (GB) ..... 0208454.9

(51) Int. Cl.
*B65B 31/04* (2006.01)

(52) U.S. Cl. ..... 53/403; 53/452; 53/477; 53/79; 53/551; 53/374.8

(58) Field of Classification Search ..... 53/403, 53/450, 452, 477, 79, 551, 552, 285, 374.8
See application file for complete search history.

(56) References Cited

U.S. PATENT DOCUMENTS 3,575,757 A * 4/1971 Smith ..... 53/403
3,817,803 A * 6/1974 Horsky ..... 53/403
3,938,298 A * 2/1976 Luhman et al. ..... 53/403
4,021,283 A * 5/1977 Weikert ..... 53/426
5,021,039 A 6/1991 Richter et al.
5,335,483 A * 8/1994 Gavronsky et al. ..... 53/451
5,660,662 A * 8/1997 Testone ..... 53/403
5,873,215 A * 2/1999 Aquarius et al. ..... 53/403
5,938,877 A * 8/1999 Schram ..... 53/403
5,942,076 A * 8/1999 Salerno et al. ..... 156/359
6,209,286 B1 4/2001 Perkins et al.
6,341,473 B1 * 1/2002 Kovacs et al. ..... 53/451
6,789,376 B1 * 9/2004 Greenwood et al. ..... 53/79
6,889,739 B1 * 5/2005 Lerner et al. ..... 53/403
6,952,910 B1 * 10/2005 Lorsch ..... 53/403

FOREIGN PATENT DOCUMENTS

DE 199 13 408 10/2000

(Continued)

*Primary Examiner*—Louis Huynh
(74) *Attorney, Agent, or Firm*—Young & Thompson

(57) ABSTRACT

A method and apparatus for forming void-fill packaging wherein a tubular plastics material (11) is periodically fed via driver rollers (15) along a longitudinal guide path (12), first and second transverse spaced parallel heat seals are formed substantially across the plastics material via a transverse heat sealer (36, 38) to define a chamber (104) between the seals, a fluid is discharged into the chamber via a nozzle (20) positioned along the guide path and adapted to extend inside the tubular plastics material adjacent to one longitudinal edge of the plastic material, a third heat seal is formed via a longitudinal heat sealer (78) to seal the chamber (104), and the longitudinal edge of the tubular plastic material is cut via a cutting element (22) so that the movement of the tubular plastics material is not hindered by the nozzle.

20 Claims, 4 Drawing Sheets

FOREIGN PATENT DOCUMENTS

GB 2 178 694 2/1987

WO WO 01 74686 10/2001

* cited by examiner

APPARATUS AND METHOD FOR FORMING VOID-FILL PACKAGING

BACKGROUND OF THE INVENTION

This invention relates to apparatus for forming void-fill packaging, and to a method of using the apparatus and the material.

Void-fill packages, such as air-cushion packages, are well-known. They are used in parcels to help protect the contents from shock and damage, and are inserted into spaces or voids which exist between the contents and the sides of the parcel.

Void-fill packaging is created using a roll of tubular plastics material which is preformed with transverse perforations. Separate pieces of apparatus are also used to form, between the perforations, transverse and longitudinal heat seals by which a fluid discharged into the tubular plastics material is held therein.

The use of a plurality of discrete machines to preform the perforations and to form the transverse and longitudinal heat seals leads to a decrease in productivity and an increase in associated costs.

The present invention seeks to overcome this problem.

SUMMARY OF THE INVENTION

According to a first aspect of the present invention, there is provided apparatus for forming void-fill packaging, the apparatus comprising a longitudinal guide path along which tubular plastics material can pass, drive means for moving the plastics material along the guide path, transverse heat sealing means for forming first and second transverse spaced parallel heat seals substantially across the plastics material, the first and second heat seals acting to define a chamber there between, a nozzle which is adapted to, in use, extend inside the plastics material adjacent to one longitudinal edge thereof and which can discharge a fluid into the chamber, longitudinal heat sealing means for forming a third heat seal which seals the chamber, and a cutting element which cuts the said one longitudinal edge so that the movement of the tubular plastics material is not hindered by the nozzle.

According to a second aspect of the present invention, there is provided apparatus for forming void-fill packaging, the apparatus comprising means for supporting a roll of tubular plastics material, drive means for moving the tubular plastics material from the roll and along a longitudinal guide path, first and second heaters extending transversely of the guide path adjacent to one end of the apparatus for creating pairs of spaced apart transversely extending heat seals at spaced intervals along the tubular plastics material as it is drawn from the roll, perforating means between the first and second heaters for creating a transversely extending row of perforations between each pair of heat seals, an elongate nozzle extending parallel to the longitudinal guide path and insert able in the tubular plastics material so as to extend along one longitudinal edge of the tubular material downstream of the first and second heaters, and means for supplying air under pressure to the nozzle to fill chambers created between adjacent pairs of heat seals.

According to a third aspect of the present invention, there is provided apparatus in accordance with the first and/or second aspects of the present invention in combination with tubular plastics material.

According to a fourth aspect of the present invention, there is provided a method of forming void-fill packaging using a combination in accordance with the third aspect of the present invention, the method comprising the steps of:

a) feeding one end of the tubular plastics material onto the longitudinal guide path so that the nozzle passes into the tubular plastics material along, or adjacent to, one longitudinal edge thereof,
b) attaching the said end of the plastics material to the drive means,
c) operating the drive means so that the tubular plastics material is periodically moved along the guide path,
d) during consecutive periods when the plastics material is stopped on the guide path, respectively:
   1) forming a transverse heat seal substantially across the plastics material;
   2) forming another transverse heat seal substantially across the plastics material so that a chamber is defined between the two transverse heat seals; and
   3) discharging a fluid from the nozzle into the chamber and forming a third heat seal which seals the chamber,
e) cutting the said one longitudinal edge to remove the plastics material from the nozzle, and
f) repeating steps (d) and (e).

BRIEF DESCRIPTION OF THE DRAWINGS

The present invention will now be described, by way example, with reference to the accompanying drawings, in which.

DETAILED DESCRIPTION OF THE DRAWINGS

Figure 1:
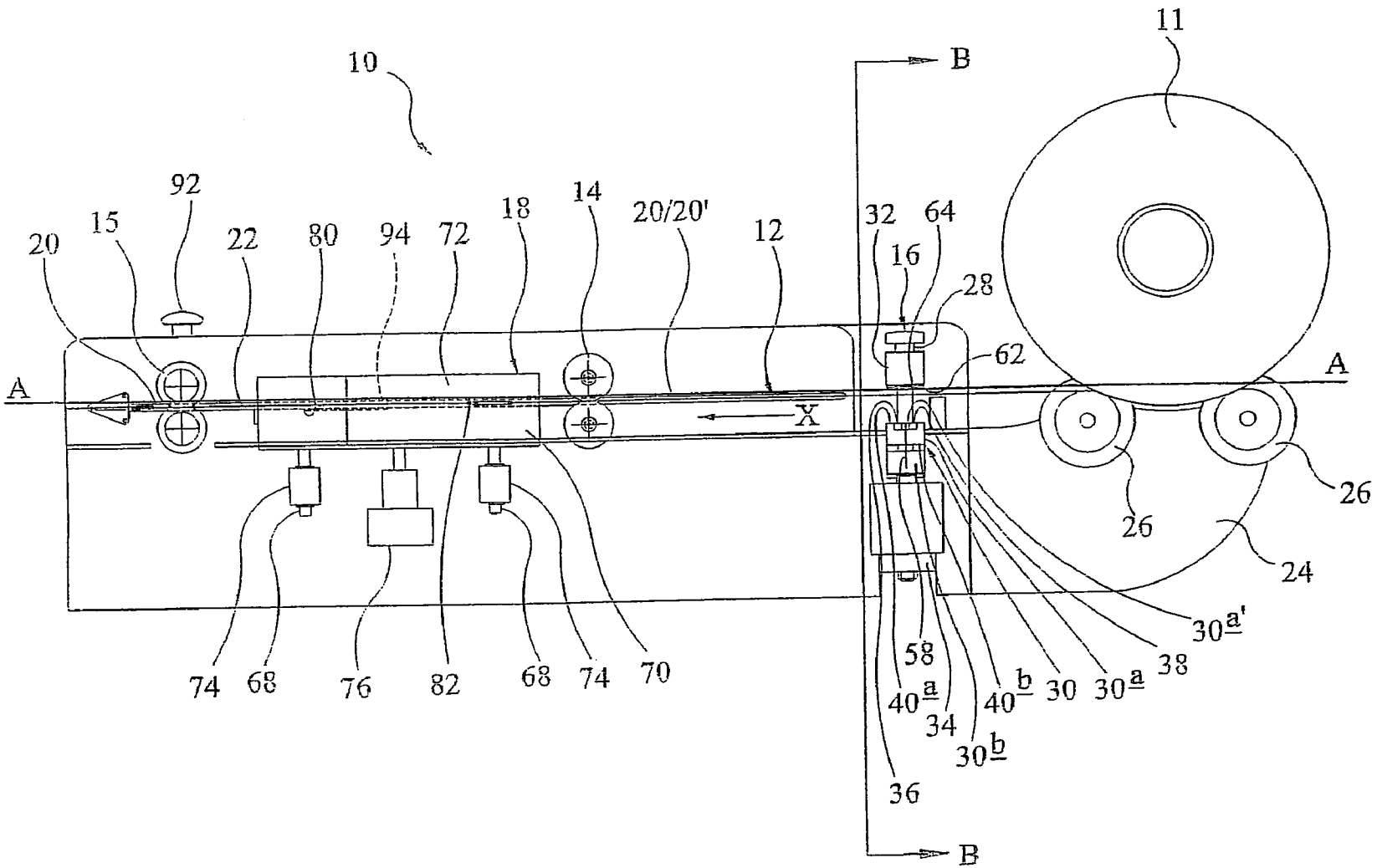
FIG. 1 is a schematic side view of one embodiment of apparatus for forming void-fill packaging, in accordance with the first aspect of the present invention.

Referring to the drawings, apparatus 10 for forming void fill packaging from plastics material 11 is shown therein. The apparatus 10 comprises a longitudinal guide path 12 along which the plastics material 11 can be moved in a direction shown by arrow X, a pair of rotatable support wheels 14, drive means which includes a pair of motorised drive wheels 15 downstream of the support wheels 14, a first press 16 upstream of the support wheels 14 and extending transversely to the guide path 12, a second press 18 which is positioned between the support wheels 14 and the drive wheels 15 and which extends in parallel with the longitudinal extent of the guide path 12, along or adjacent to one longitudinal edge 12' thereof, a nozzle 20 which is positioned downstream of the first press 16, a main elongate part 20' of which extends parallel, and adjacent, to the one longitudinal edge 12' of the guide path 12 and which is supported by the support wheels 14, and a cutting element 22 which is positioned upstream of the drive wheels 15.

The apparatus 10 also comprises means for supporting a roll of the plastics material 11. The support means includes a support member 24, which is positioned upstream of the first press 16, and two rollers 26 which are supported by the support member 24 in spaced parallel relationship and on which the plastics material 11 can be supported and wound off.

The plastics material 11 is tubular, being typically a one-piece extrusion with no longitudinal seams and no preformed perforations. The plastics material 11 is also preferably a starch-based or other biodegradable plastics material. However, the plastics material may be formed from low-density polyethylene (LDPE) or Metallocene.

The first press 16 comprises two upstanding guide elements 28 which are positioned on opposite sides of the guide path 12, a lower beam support 30 and an upper beam support 32. The lower and upper beam supports 30 and 32 are mounted on the guide elements 28 and extend transversely to the guide path 12 so that the guide path 12 passes there between.

The lower beam support 30 is slidably mounted on the guide elements 28 and comprises an upper beam part 30*a* and a lower beam part 30*b* which are spring-biased apart from each other. A solenoid actuator 34, in use, acts on the lower beam part 30*b* to drive the lower beam support 30 upwards and urge the lower beam part 30*b* towards the upper beam part 30*a*.

The upper beam part 30*a* includes an elongate transverse through-slot 30*a*' which opens out on the upper and lower surfaces 40*a* and 40*b* of the upper beam part 30*a*. Transverse heat sealing means includes first and second energisable heating platens 36 and 38 which are mounted upwardly-facing on the upper surface 40*a* so that the slot 30*a*' is interposed there between. Both heating platens 36 and 38 are oriented to extend, in parallel spaced relationship, transversely to the longitudinal extent of the guide path 12.

To compensate for the expansion and contraction which the first and second heating platens 36 and 38 undergo when energised and deenergised, the transverse heat sealing means also includes compensation means by which the first and second heating platens 36 and 38 are mounted on the upper beam part 30*a* of the lower beam support 30.

Figure 3:
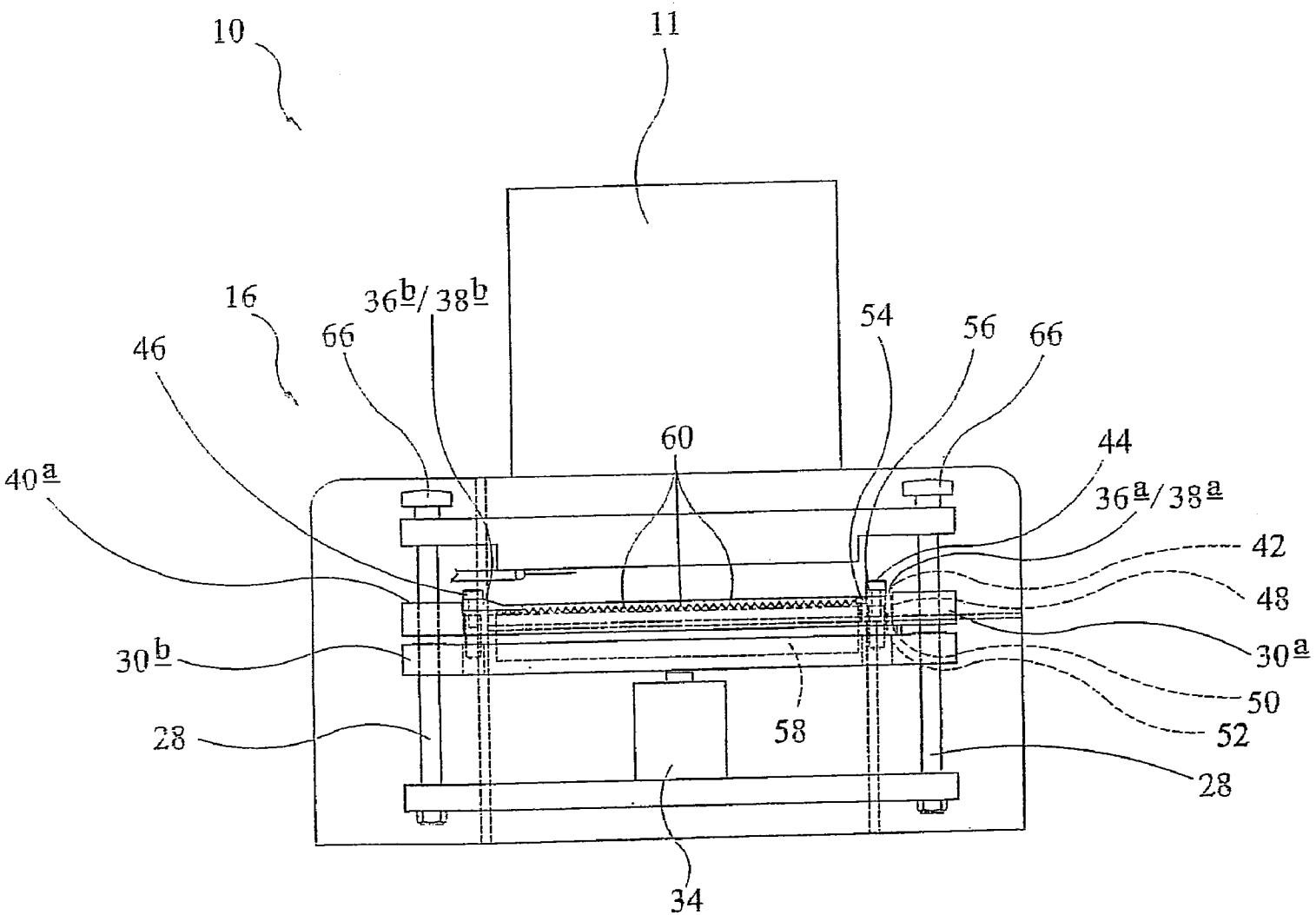
FIG. 3 is a slightly enlarged end view taken along the line B—B in FIG. 1.
Figure 4:
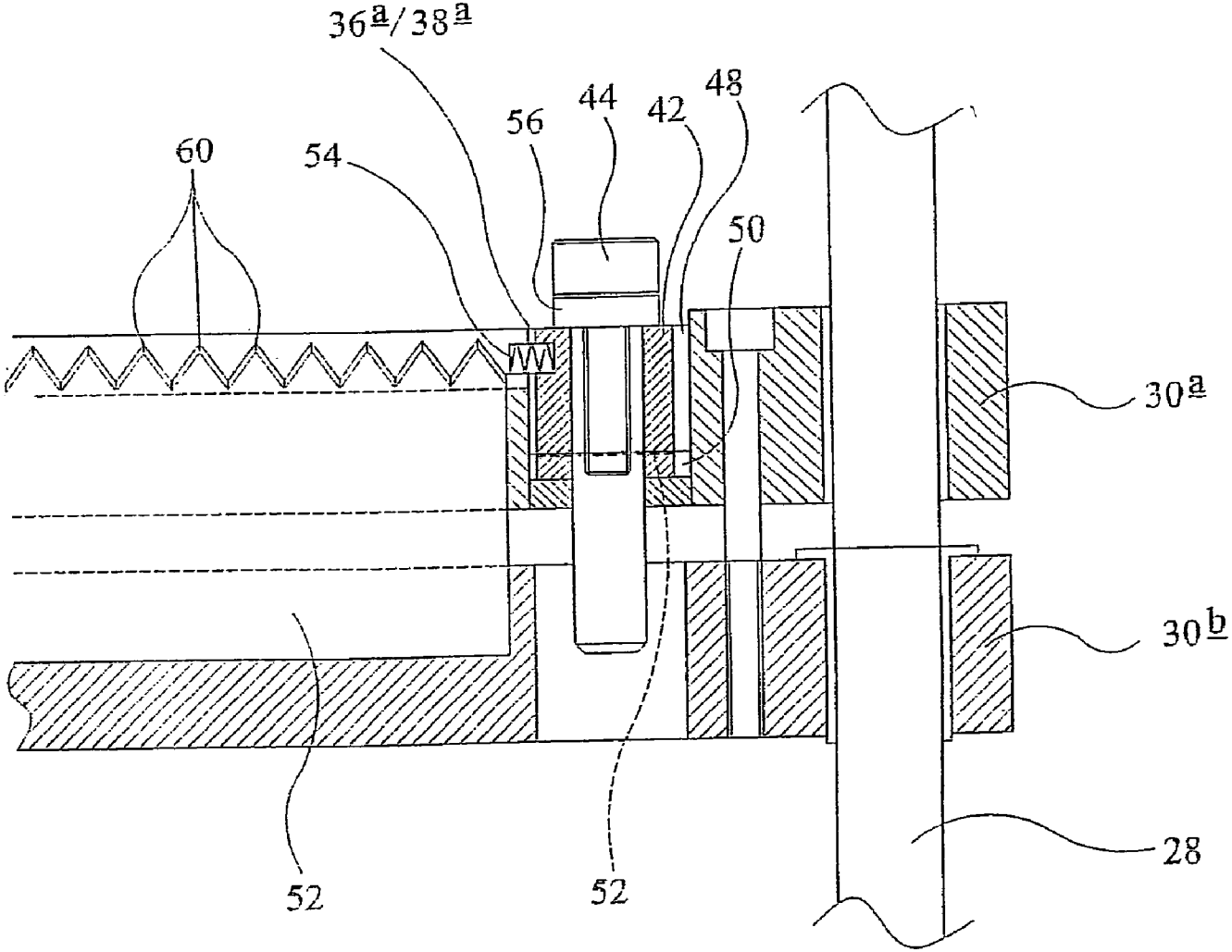
FIG. 4 is an enlarged view of part of FIG. 3 showing one end of the lower beam support.

As can best be seen in FIGS. 3 and 4, the compensation means comprises a slidable block member 42, and first and second retaining elements 44 and 46.

The slidable block member 42, being typically formed from PTFE or other heat resistant material, has an inverted 'T'-shape, which, in FIG. 4, is oriented to extend through the plane of the paper. The block member 42 is received in an opening 48 which is formed through the upper beam part 30*a*, parallel to the through-slot 30*a*'. The opening 48 has a stepped bore, stepped in the direction perpendicular to the plane of the paper in FIG. 4, that defines shoulder portions 50. The opening 48 is dimensioned to enable the block member 42 to slide or move horizontally parallel to the longitudinal extent of the upper beam part 30*a*, and the arms 52, which correspond to flange portions, of the block member 42 can bear against the shoulder portion 50 to prevent or substantially prevent upwards displacement of the block member 42 relative to the upper beam part 30*a*.

The block member 42 is sprung-biased in a direction away from the through-slot 30*a*' by a pair of tension springs 54 (only one shown in FIGS. 3 and 4) which act between the side of the block member 42 and the upper beam part 30*a*.

The first retaining element 44 clamps adjacent first end portions 36*a* and 38*a* of the first and second heating platens 36 and 38 to the slidable block member 42 via a heat-insulating clamping washer 56.

The second retaining element 46 clamps adjacent second end portions 36*b* and 38*b* of the first and second heating platens 36 and 38 to the upper surface 40*a* of the upper beam part 30*a*. Consequently, the first and second heating platens 36 and 38 are only fixed to the upper beam part 30*a* at two points.

The first and second heating platens 36 and 38 therefore lay in tension, due to the tension springs 54, on the upper surface 40*a* of the upper beam part 30*a*. When the first and second heating platens 36 and 38 are energised and expand, the slidable block member 42 can move horizontally in the opening 48 to compensate for the expansion. Similarly, when the first and second heating platens 36 and 38 are deenergised and contract, the slidable block member 42 can again move to compensate for the contraction.

The lower part 30*b* of the lower beam support 30 supports perforating means in the form of an upstanding blade element 58 having a plurality of upwardly-facing pointed teeth 60. The height of the blade element 58 is sufficient to be slidably received in the slot 30*a*' of the upper part 30*a* and, when the first press 16 is operated, to be able to project through the slot 30*a*' and above the first and second heating platens 36 and 38.

The upper beam support 32 supports, on its downwardly facing surface 62, a bearing member 64, typically in the form of a silicone rubber pad, against which the first and second heating platens 36 and 38 and the blade element 58 can press.

To enable removal and replacement of the upper and lower beam supports 30 and 32, for example when the first and/or second heating platens 36 and 38 require maintenance, removable stops 66 are provided on the ends of the guide elements 28.

The second press 18 comprises two guide elements 68, a lower beam support 70 and an upper beam support 72. The lower and upper beam supports 70 and 72 are positioned adjacent to, and extend in parallel with, the longitudinal edge 12' of the guide path 12. The guide elements 68 extend from the bottom of the lower beam support 70 and are slidably received in bearing elements 74 fixedly located beneath the guide path 12. A solenoid actuator 76, in use, acts on the lower beam support 70 to urge it towards the upper beam support 72.

Longitudinal heat sealing means includes a third energisable heating platen 78 which is mounted upwardly facing on the lower beam support 70 and extends parallel to the longitudinal extent of the guide path 12. Similarly to the first press 16, the upper beam support 72 supports a downwardly facing bearing member 80, typically in the form of a silicone rubber pad, against which the third heating platen 78 can press. The third heating platen 78 is positioned so that its longitudinal axis intersects the longitudinal axes of the first and second heating platens 36 and 38.

The longitudinal heat sealing means may also include compensation means (not shown), as described above with reference to the transverse heat sealing means, by which the third heating platen 78 is mounted on the lower beam support 70.

The nozzle 20 is an elongate tubular element having a blind bore. The main part 20' of the nozzle 20 is parallel or substantially parallel to the longitudinal extent of the third heating platen 78 and is disposed between the third heating platen 78 and the longitudinal edge 12' of the guide path 12. The nozzle 20 projects beyond opposite ends of the second press 18, and an inboard-facing fluid discharge opening 82 is formed in the wall of the nozzle 20. The nozzle 20 is supplied with a pressurised fluid, typically in the form of compressed air from a compressor 84.

As shown in FIG. 1, the compressor 84 is an internal or onboard compressor which is housed adjacent to the second press 18. However, the compressor may be an external or remote compressor.

The rotatable support wheels 14 are disposed in vertical alignment with each other, between the first and second presses 16 and 18, and are positioned so that the nozzle 20 is interposed therebetween and is supported in respective circumferential support channels 86 of the support wheels 14.

The motorised drive wheels 15 of the drive means are also disposed in vertical alignment with each other, downstream of the second press 18, and are offset inboard from the nozzle 20. As can best be seen in FIG. 1, the drive wheels 15 are set to drive at an angle to the longitudinal extent of the guide path 12. This compensates for the shape of the plastics material 11 when inflated, and thus enables the plastics material 11 to be passed through the drive wheels 15 without or substantially without bunching or backing up.

The drive wheels 15 are mounted in bearings 88 and are driven by an electric motor 90. The relative spacing between the drive wheels 15 can be adjusted via an adjusting member 92.

The drive means also includes means for monitoring the length of material which passes along the guide path 12 between successive operations of the first press 16 and for setting/adjusting the period of energisation of the electric motor 90. The monitoring and setting means include a sensing wheel 94, which is spring mounted to be lightly biased against the main part 20' of the nozzle 20, and suitable electronic circuitry (not shown) which is connected to the output of the sensing wheel 94 and which can set or adjust the period of energisation of the electric motor 90 based on a manually input requirement.

Since the sensing wheel 94 is spring-biased against the nozzle 20, when the plastics material 11 is interposed therebetween, the sensing wheel 94 frictionally engages the outer surface of the plastics material 11 and rotates with movement of the plastics material 11 along the guide path 12.

Since void-fill packages generally have a length which is a multiple of 50 millimetres (mm), the sensing wheel 94 has a circumference which is also a multiple of 50 mm, being in this case 200 mm. The sensing wheel 94 has a plurality of equi-angularly spaced openings 96, being in this case four, and a proximity sensor (not shown), in use, monitors the occurrence of the openings 96 as the sensing wheel 94 rotates.

The electric circuitry can thus determine, from the output of the proximity sensor and based on the required size of the void-fill packages, when to halt the movement of the plastics material 11. The movement of the plastics material 11 is thus regulated.

The cutting element 22 is interposed between the drive wheels 15 and the second press 18, and is positioned at or adjacent to the end of the main part 20' of the nozzle 20.

Figure 2:
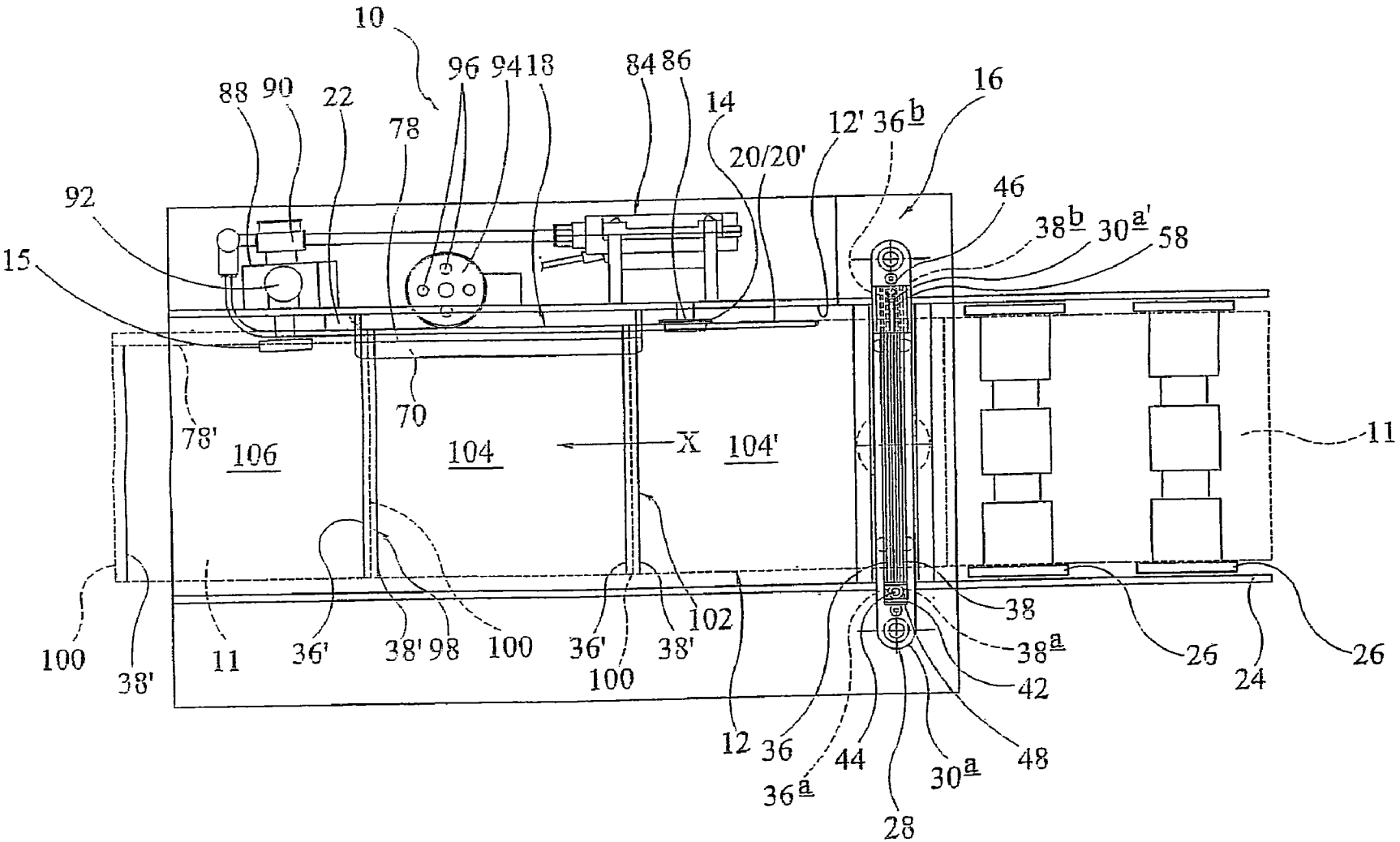
FIG. 2 is a schematic plan view taken along the line A—A in FIG. 1.

In use, the roll of tubular plastics material 11 is first mounted on the support rollers 26 of the support means. The end of the plastics material 11 is then wound off the roll, passed through the first press 16, between the lower and upper beam supports 30 and 32, and threaded onto the main part 20' of the nozzle 20. The plastics material 11 is fed along the guide path 12 and the nozzle 20, between the support wheels 14, through the second press 18 between its lower and upper beam supports 70 and 72, passed the spring-biased sensing wheel 94, and engaged between the drive wheels 15. In this position, the wound off length of the tubular plastics material 11, indicated by phantom lines in FIG. 2, lies flat or substantially flat across the guide path 12 with the main part 20' of the nozzle 20 lying along or substantially along one interior longitudinal edge 11' of the plastics material 11.

When the apparatus 10 is operated, the drive wheels 15 draw a predetermined length of the tubular plastics material 11 along the guide path 12, which is preset and monitored as described above.

When the drive wheels 15 are first stopped, the first press 16 is operated by energising the solenoid actuator 34. This causes the lower beam support 30 to be raised towards the upper beam support 32. As the lower beam support 30 rises, the plastics material 11 is first sandwiched between the energised first and second heating platens 36/38 of the upper part 30*a* and the bearing member 64, so that a first set 98 of first and second heat seals 36' and 38' are formed substantially across the transverse extent of the tubular plastics material 11. The first and second heat seals 36' and 38' do not extend across the entire transverse extent of the plastics material 11, thereby providing a gap for passage of the nozzle 20 as the plastics material 11 moves along the guide path 12.

As the energisation of the solenoid actuator 34 continues, the lower part 30*b* is urged towards the upper part 30*a* against the spring-biasing. This causes the perforating blade element 58 to slide upwards in the slot 30*a'*, towards the bearing member 64 and between the first and second heating platens 36 and 38, resulting in a line of perforations 100 being formed across or substantially across the plastics material 11 between the first and second beat seals 36' and 38'.

The plastics material 11 is then moved along the guide path 12 by a further distance, and the first press 16 is operated again to form a second set 102 of the first and second transverse heat seals 36'/38' and perforations 100.

The consecutive formation of the two sets 98 and 102 of first and second transverse heat seals 36' and 38' results in a chamber 104 being defined in the plastics material 11 between the second transverse heat seal 38' of the first set 98 and the first transverse heat seal 36' of the second set 102.

The plastics material 11 is then drawn by a further distance along the guide path 12 until the chamber 104 is aligned with the third heating platen 78 of the second press 18.

Fluid, which may be permanently or selectively supplied, is discharged from the fluid discharge opening 82 of the nozzle 20 into the chamber 104. The second solenoid actuator 76 is then energised, causing the lower beam support 70 to be raised towards the upper beam support 72 so that the plastics material 11 is sandwiched between the energised third heating platen 78 and the bearing member 80 to form a third heat seal 78'. Since the length of the third heating platen 78 spans the distance between the between the second transverse heat seal 38' of the first set 98 and the first transverse heat seal 36' of the second set 102 of the respective chamber 104, the third heat seal 78' intersects the second transverse heat seal 38' and the first transverse heat seal 36', so as to fluid-tightly seal the chamber 104 and form a void-fill package 106.

The second press 18 is positioned at a suitable distance downstream from the first press 16 so that, when the plastics material 11 is positioned for forming of the third heat seal 78', the first press 16 can also be, typically simultaneously, operated to form a further set (not shown) of the first and second heat seals. This results in a further separate chamber 104' being defined immediately adjacent to the chamber 104 between the second heat seal 38' of the second set 102 and the first heat seal of the further set, and therefore optimum utilisation of the plastics material 11.

The drive wheels 15 then move the plastics material 11 along the guide-path 12 towards the cutting element 22. As the plastics material 11 contacts the cutting element 22, the longitudinal edge 11' is cut to enable the plastics material 11 to be removed from the nozzle 20 without damaging the void-fill package 106 or causing the movement of the plastics material 11 to be hindered.

The void-fill package 106 can then be separated from the roll of plastics material 11 by tearing along the perforations 100.

It would, of course, be possible to provide two sets of first presses 16. This, depending on the relative spacing therebetween, could enable the first and second sets 98 and 102 of first and second seals 36' and 38' to be formed during only one of the periodic stops of the plastics material 11.

Furthermore, the circumference of the sensing wheel could be altered to accommodate different lengths of void-fill packaging, in addition or alternatively to those mentioned. In this case, the number of sensing wheel openings 96 may also need to be altered.

Although the sensing wheel is typically formed from a ferrous material and the proximity sensor is a magnetic type sensor, other materials and other types of proximity sensor could be used.

The apparatus described above can thus form void-fill packaging from an initially unperforated length of tubular plastics material, and can also produce void-fill packaging of varying sizes using only a single type of tubular plastics material. Since the apparatus is a single discrete unit, an increase in production speed and a decrease in costs is realised. The use of compensation means to mount the heating platens prevents unwanted buckling, and therefore leads to an increase in the integrity of the fluid-tight seals, and the use of angled drive wheels results in a more continuous movement of material along the guide path.

The embodiments described above are given by way of example only and various modifications will be apparent to persons skilled in the art without departing from the scope of the invention as defined by the appended claims. For example, the solenoid actuators could be pneumatic actuators, and only one of the drive wheels could be driven, the other being an idler.

The invention claimed is:

1. A method of forming void-fill packaging comprising the steps of:

a) feeding one end of tubular plastics material onto a longitudinal guide path so that a nozzle passes into a tubular plastics material along, or adjacent to, one longitudinal edge thereof, b) attaching the said end of the plastics material to drive means, c) operating the drive means so that the tubular plastics material is periodically moved along the guide path, d) during consecutive periods when the plastics material is stopped on the guide path, respectively:

1) forming a transverse heat seal substantially across the plastics material;

2) forming another transverse heat seal substantially across the plastics material so that a chamber is defined between the two transverse heat seals; and 3) discharging a fluid from the nozzle into the chamber and forming a third heat seal which seals the chamber, e) cutting the said one longitudinal edge to remove the plastics material from the nozzle, and f) repeating steps (d) and (e).

2. A method as claimed in claim 1, wherein, in step (d), with respect to separate chambers, operations (1) and (2) are performed during one of the consecutive periods.

3. A method as claimed in claim 1, wherein, in step (d), with respect to a further separate chamber, operation (3) is also performed during the said one period.

4. Apparatus for forming void-fill packaging, the apparatus comprising a longitudinal guide path along which tubular plastics material can pass, drive means for moving the plastics material along the guide path, transverse heat sealing means for forming first and second transverse spaced parallel heat seals substantially across the plastics material, the first and second heat seals acting to define a chamber therebetween, a nozzle positioned along the guide path and adapted to, in use, extend inside the plastics material adjacent to one longitudinal edge thereof and to discharge fluid into the chamber, longitudinal heat sealing means for forming a third heat seal which seals the chamber, and a cutting element which cuts the said one longitudinal edge so that the movement of the tubular plastics material is not hindered by the nozzle.

5. Apparatus as claimed in claim 4, wherein the first heat sealing means comprises a first heating platen, by which the first heat seal of a first said chamber is formed, and a second heating platen by which the second heat seal of a second said chamber is formed.

6. Apparatus as claimed in claim 4, further comprising perforating means for forming a perforation across the plastics material between the first and second heat seals of adjacent chambers.

7. Apparatus as claimed in claim 4, wherein the perforating means comprises a perforating blade element.

8. Apparatus as claimed in claim 4, wherein the perforating means is disposed between the first and second heating platens.

9. Apparatus as claimed in claim 8, wherein the first heat sealing means and the perforating means are disposed together on a first press through which the guide path extends.

10. Apparatus as claimed in claim 9, wherein the first press comprises an upper beam support and a lower beam support which has an upper part and a separate lower part, the first heat sealing means being disposed on the upper part and the perforating means being disposed on the lower part.

11. Apparatus as claimed in claim 10, wherein the upper and lower parts of the lower beam support are spring-biased apart.

12. Apparatus as claimed in claim 10, wherein the perforating means is slidably received in the upper part of the lower beam support.

13. Apparatus as claimed in claim 4, wherein the longitudinal heat sealing means comprises a third heating platen by which the third heat seal is formed, the third heating platen extending parallel to the longitudinal extent of the guide path and being positioned so that, when the third heat seal is formed, it intersects the first and second heat seals.

14. Apparatus as claimed in claim 4, wherein the transverse and/or longitudinal heat sealing means includes compensation means to compensate for expansion and contraction exhibited during energisation and deenergisation.

15. Apparatus as claimed in claim 4, wherein the nozzle is an elongate tubular element, the main part of which extends parallel or substantially parallel to the longitudinal extent of the guide path.

16. Apparatus as claimed in claim 15, wherein the said elongate tubular element has a blind bore and a fluid discharge opening which is formed in its wall at a position corresponding to the longitudinal heat sealing means.

17. Apparatus as claimed in claim 4, wherein the drive means includes means for monitoring and setting the distances the plastics material is drawn along the guide path between successive operations of the first press.

18. Apparatus as claimed in claim 17, wherein the monitoring means includes a sensing wheel which, in use, is driven by the movement of the plastics material.

19. Apparatus as claimed in claim 18, wherein the sensing wheel has a plurality of openings, and, when in use the sensing wheel rotates, a proximity sensor monitors the occurrence of the openings so that the movement of the plastics material is regulated.

20. Apparatus for forming void-fill packaging comprising:

a) means for feeding one end of tubular plastics material onto a longitudinal guide path so that a nozzle passes into a tubular plastics material along, or adjacent to, one longitudinal edge thereof, b) means for attaching the said end of the plastics material to drive means, c) means for operating the drive means so that the tubular plastics material is periodically moved along the guide path, d) means, during consecutive periods when the plastics material is stopped on the guide path, respectively:

1) for forming a transverse heat seal substantially across the plastics material;

2) for forming another transverse heat seal substantially across the plastics material so that a chamber is defined between the two transverse heat seals; and 3) for discharging a fluid from the nozzle into the chamber and forming a third heat seal which seals the chamber, e) means for cutting the said one longitudinal edge to remove the plastics material from the nozzle.

* * * * *